US009987518B1

(12) United States Patent
Stack et al.

(10) Patent No.: US 9,987,518 B1
(45) Date of Patent: Jun. 5, 2018

(54) BALANCE BOARD

(71) Applicants: Louis John Stack, Calgary (CA); Tynan Louis Stack, Calgary (CA)

(72) Inventors: Louis John Stack, Calgary (CA); Tynan Louis Stack, Calgary (CA)

( * ) Notice: Subject to any disclaimer, the term of this patent is extended or adjusted under 35 U.S.C. 154(b) by 0 days. days.

(21) Appl. No.: 15/419,243

(22) Filed: Jan. 30, 2017

(51) Int. Cl.

| | |
|---|---|
| ***A63B 23/00*** | (2006.01) |
| ***A63B 22/16*** | (2006.01) |
| *A63B 21/00* | (2006.01) |
| *A63B 22/18* | (2006.01) |
| *A63G 23/00* | (2006.01) |

(52) U.S. Cl.
CPC ..... *A63B 22/16* (2013.01); *A63B 21/4047* (2015.10); *A63B 21/4049* (2015.10); *A63B 22/18* (2013.01); *A63G 23/00* (2013.01)

(58) Field of Classification Search
CPC .. A63G 23/00; A63B 22/16; A63B 21/00178; A63B 21/022; A63B 21/4009; A63B 21/4027; A63B 21/4029; A63B 21/4031; A63B 21/4047; A63B 21/4049; A63B 22/0064; A63B 22/0066; A63B 22/18; A63B 23/02; A63B 23/0205; A63B 2208/12
USPC ..... 472/135
See application file for complete search history.

(56) References Cited

U.S. PATENT DOCUMENTS

| | | | | |
|---|---|---|---|---|
| 4,463,946 | A | 8/1984 | Wallace | |
| 4,509,743 | A | 4/1985 | Lie | |
| 4,635,932 | A | 1/1987 | Dewees | |
| 5,062,629 | A | 11/1991 | Vaughan | |
| 5,092,586 | A | 3/1992 | Tuthill | |
| 5,810,703 | A | 9/1998 | Stack | |
| 5,813,958 | A | 9/1998 | Tomita | |
| 6,019,712 | A | 2/2000 | Duncan | |
| 6,558,304 | B1 | 5/2003 | Bardon | |
| 6,705,977 | B1 | 3/2004 | Ziak | |
| 7,004,895 | B2 | 2/2006 | Perry | |
| 7,090,621 | B2 | 8/2006 | Loane | |
| 7,121,831 | B2 | 10/2006 | Hojo | |
| 7,147,593 | B2 * | 12/2006 | Vittone | A63B 22/16 482/142 |
| 7,175,577 | B2 | 2/2007 | Greenspan | |
| 7,303,508 | B2 | 12/2007 | Toyama | |
| 7,374,522 | B2 | 5/2008 | Arnold | |
| 7,425,189 | B1 | 9/2008 | Eschenbach | |

(Continued)

*Primary Examiner* — Gregory Winter
*Assistant Examiner* — Megan Anderson
(74) *Attorney, Agent, or Firm* — Quickpatents, LLC; Kevin Prince

(57) ABSTRACT

A balancing board is disclosed with a base and an elongated deck including a top surface; longitudinal and central lateral axes; and a bottom surface, which includes at the central lateral axis a center post mounting mechanism. The base's bottom side rests on a support surface. The base's top side has a top surface and is rotatable with respect to the bottom side at a rotational bearing. A center post is fixed at its bottom end to and extends upwards from the base's top surface, and has at its top end a pair of roller posts extending laterally and horizontally from the center post at opposing sides. Each roller post rotationally mounts a roller, extended downwardly from the roller post, below the center post's top end. The center post mounting mechanism engages with and aligns each roller with the central lateral axis on opposing sides of the longitudinal axis.

17 Claims, 4 Drawing Sheets

(56) References Cited

U.S. PATENT DOCUMENTS

| | | | | |
|---|---|---|---|---|
| 7,465,253 | B2 | 12/2008 | Perry | |
| 7,670,230 | B2 | 3/2010 | Hsu | |
| 7,722,506 | B2 | 5/2010 | Pratson | |
| 7,753,831 | B2 | 7/2010 | Langer | |
| 7,811,217 | B2 | 10/2010 | Odien | |
| 7,985,169 | B2 | 7/2011 | Tudico | |
| 8,246,354 | B2 | 8/2012 | Chu | |
| 8,398,531 | B2 | 3/2013 | Tudico | |
| 8,986,180 | B1 | 3/2015 | VanBuren | |
| 8,998,784 | B1 | 4/2015 | Sloan | |
| 9,370,705 | B2 | 6/2016 | Grzesiak | |
| 9,415,287 | B2 | 8/2016 | Greiwe | |
| 2003/0017922 | A1 | 1/2003 | Sachs | |
| 2006/0030795 | A1 | 2/2006 | Luberski | |
| 2007/0184953 | A1 | 8/2007 | Luberski | |
| 2007/0207900 | A1 | 9/2007 | Huang | |
| 2008/0228110 | A1 | 9/2008 | Berme | |
| 2009/0227426 | A1* | 9/2009 | Dubar | A63B 21/0004 482/34 |
| 2011/0196270 | A1 | 8/2011 | Fuster | |
| 2014/0287896 | A1 | 9/2014 | Kern | |
| 2014/0371041 | A1 | 12/2014 | Terpstra | |
| 2015/0251049 | A1 | 9/2015 | Kolvenbach | |
| 2016/0199699 | A1 | 7/2016 | Klassen | |
| 2017/0197105 | A1* | 7/2017 | Stockhausen | A63B 21/22 |

* cited by examiner

BALANCE BOARD

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to fitness equipment, and more particularly to an advanced tri-plane, multi-directional balancing board adapted to require a user to control all aspects of his balance through not only the traditional pitch, tilt, and yaw movements, but also by unpredictable perturbation of the user through the balance board's slip mechanism, which safely and efficaciously trains the user's balance; coordination; proprioceptive awareness; ankle, knee, and core strength; and ligament and tendon strength and flexibility.

BACKGROUND

This invention relates to fitness equipment, and more particularly to an advanced tri-plane, multi-directional balancing board adapted to require a user to control all aspects of his balance through not only the traditional pitch, tilt, and yaw movements, but also by unpredictable perturbation of the user through the balance board's slip mechanism, which safely and efficaciously trains the user's balance; coordination; proprioceptive awareness; ankle, knee, and core strength; and ligament and tendon strength and flexibility. The prior art includes: U.S. Pat. No. 7,465,253 (Dec. 16, 2008); U.S. Pat. No. 6,558,304 (May 6, 2003); U.S. Pat. No. 7,811,217 (Oct. 12, 2010); U.S. Pat. No. 8,398,531 (Mar. 19, 2013); U.S. Patent Application No. 20070207900 (Sep. 6, 2007); U.S. Patent Application No. 20110196270 (Aug. 11, 2011); U.S. Patent Application No. 20140371041 (Dec. 18, 2014); U.S. Pat. No. 4,509,743 (Apr. 9, 1985); U.S. Pat. No. 6,705,977 (Mar. 16, 2004); and U.S. Pat. No. 5,810,703 (Sep. 22, 1998). It is desirable to have an improved balancing board that is superior to any that is disclosed or suggested in the identified references.

SUMMARY OF THE INVENTION

The present device is a balancing board for use by a user on a horizontal support surface. The balancing board comprises an elongated deck having a top surface, a bottom surface, a longitudinal axis, and a central lateral axis. In the preferred embodiment, the top surface of the elongated deck further includes a non-slip texture. The bottom surface includes at the central lateral axis a center post mounting mechanism. The preferred embodiment of the elongated deck also includes two handle indentations in the bottom surface thereof at opposing ends thereof.

The balancing board further comprises a base having a bottom side and a top side. The bottom side has a bottom surface adapted for resting on the horizontal support surface. In the preferred embodiment, the bottom surface of the bottom side further includes at least one high-traction foot for frictionally engaging the support surface. The top side has a top surface. The top side is rotatable with respect to the bottom side at a rotational bearing. In the preferred embodiment, the base further comprises a bottom plate having the bottom side, and a top plate having the top side. In this embodiment, the rotational bearing is fixed between the bottom plate and the top plate and allows for the top plate to rotate with respect to the bottom plate.

The balancing board further comprises a resilient center post fixed at a bottom end thereof to the top surface of the base and extending upwardly therefrom. The center post is adapted to flex in any direction in plan view if the weight of the user on the balance board is sufficient to overcome the resiliency of the center post. The center post has at a top end a pair of roller posts, each extending laterally and horizontally therefrom at opposing sides thereof. In the preferred embodiment, the pair of roller posts are integrally formed from a single metal rod that traverses a roller post aperture, which extends laterally through the center post proximate the top end thereof.

A pair of cylindrical rollers is each rotationally mounted on one of the roller posts and extends downwardly therefrom lower than the top end of the center post. The center post mounting mechanism of the elongated deck engages with the rollers, such that each roller is aligned with the central lateral axis of the elongated deck on opposing sides of the longitudinal axis of the elongated deck. Each roller post further preferably includes a roller stop proximate a distal end of the roller post to maintain the roller on the roller post. Preferably, the center post mounting mechanism includes a pair of U-bolts, each fixed with the elongated deck at the bottom surface thereof. Each of the U-bolts straddles the central lateral axis of the elongated deck on opposing sides of the longitudinal axis and on opposing sides of the center post. Further, each U-bolt captures one of the rollers between itself and the elongated deck.

Also preferably, the balancing board further comprises a pair of tilt brakes each fixed with the top surface of the base and having a disengaged position that does not inhibit flexing of the center post or yaw or roll of the elongated deck, and an engaged position that inhibits flexing of the center post and yaw and roll of the elongated deck. In this configuration, each tilt brake ideally includes an elongated member pivotally fixed with a hinge at a lower end thereof with the top surface of the base and at an upper end with an elongated deck engagement surface.

In use, the bottom surface of the elongated deck contacts the center post and is captured thereon with the center post mounting mechanism, such that the elongated deck is free to move within a predefined small range in a lateral plane and in a forward/backward plane, as well as in the directions of roll, pitch, and yaw.

The present invention facilitates an exercise program requiring a user to control all aspects of his balance through not only the traditional pitch, tilt, and yaw movements, but also by unpredictable perturbation of the user through the invention's slip mechanism. The slip mechanism safely and efficaciously trains the user's balance; coordination; and proprioceptive awareness. It also benefits ankle, knee, and core strength and ligament and tendon strength and flexibility. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element. Finally, "Detailed Description" refers to this Detailed Description of the Preferred Embodiment.

Figure 1:
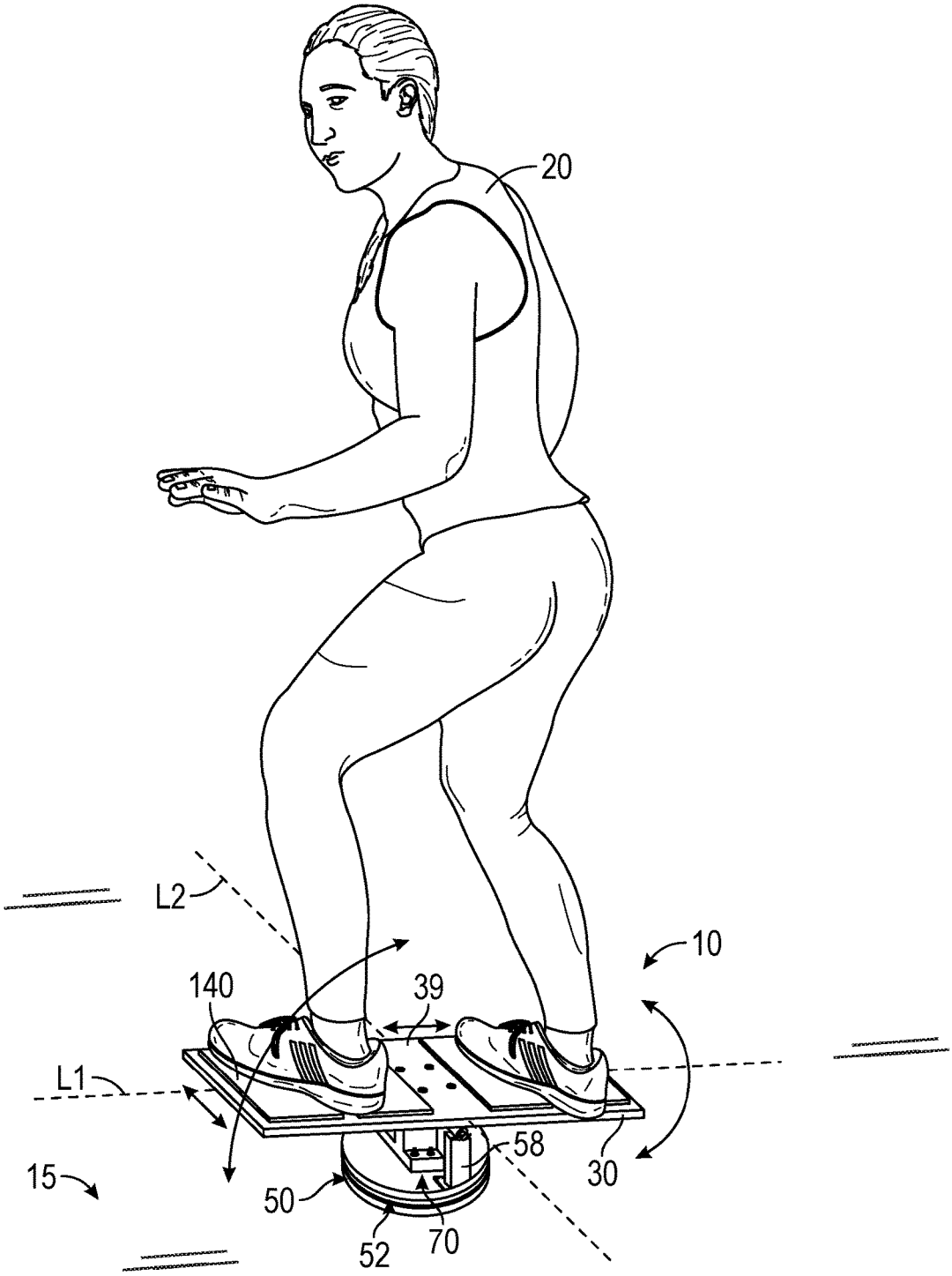
FIG. 1 is a side perspective view of one embodiment of the invention, shown in use by a person engaged in a balance exercise.
Figure 2:
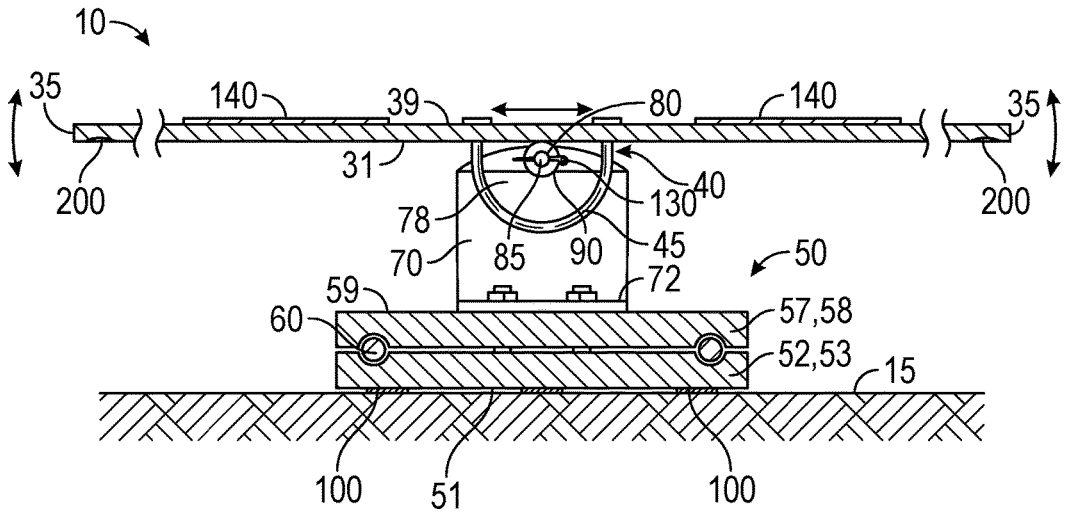
FIG. 2 is a partial cross-sectional view of the invention, taken along line $L_1$ of FIG. 1, showing a roller post assembly thereof.
Figure 3:
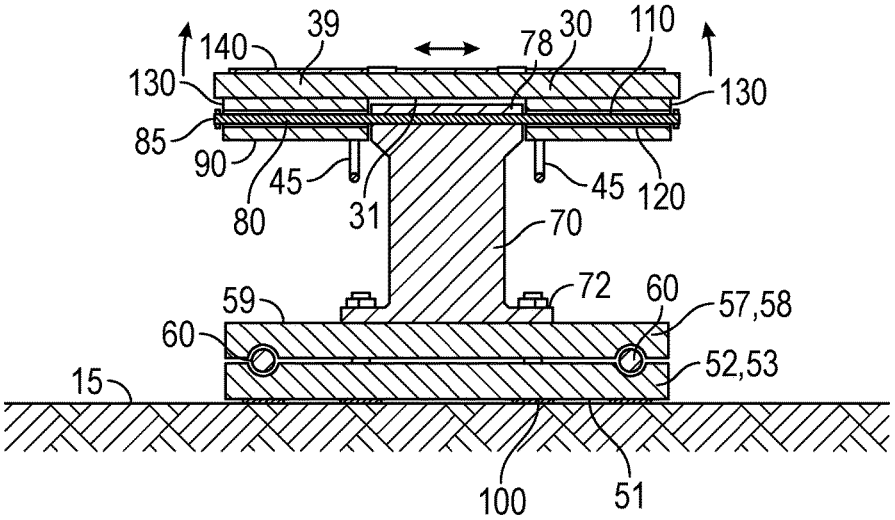
FIG. 3 is a partial cross-sectional view of the invention, taken along line $L_2$ of FIG. 1.

FIGS. 1-4 illustrate a balancing board 10 for use by a user 20 on a horizontal support surface 15 (such as a floor or ground surface). The balancing board 10 comprises an elongated deck 30 having a top surface 39, a bottom surface 31, a longitudinal axis $L_1$, and a central lateral axis $L_2$. The elongated deck 30 may be made from Baltic birch wood or any other material with similar mechanical properties. In the preferred embodiment, the top surface 39 of the elongated deck 30 further includes a non-slip texture 140 (FIGS. 1-3). The non-slip texture 140 may be included on the top surface 39 of the elongated deck 30 through application of skateboard grip tape such as that produced by Mob Grip®, or any other mechanically similar material. The bottom surface 31 includes at the central lateral axis $L_2$ a center post mounting mechanism 40 (FIG. 2). In the preferred embodiment, the elongated deck 30 also includes two handle indentations 200 (FIG. 2) in the bottom surface 31 thereof at opposing ends 35 (FIG. 2) thereof.

Figure 4:
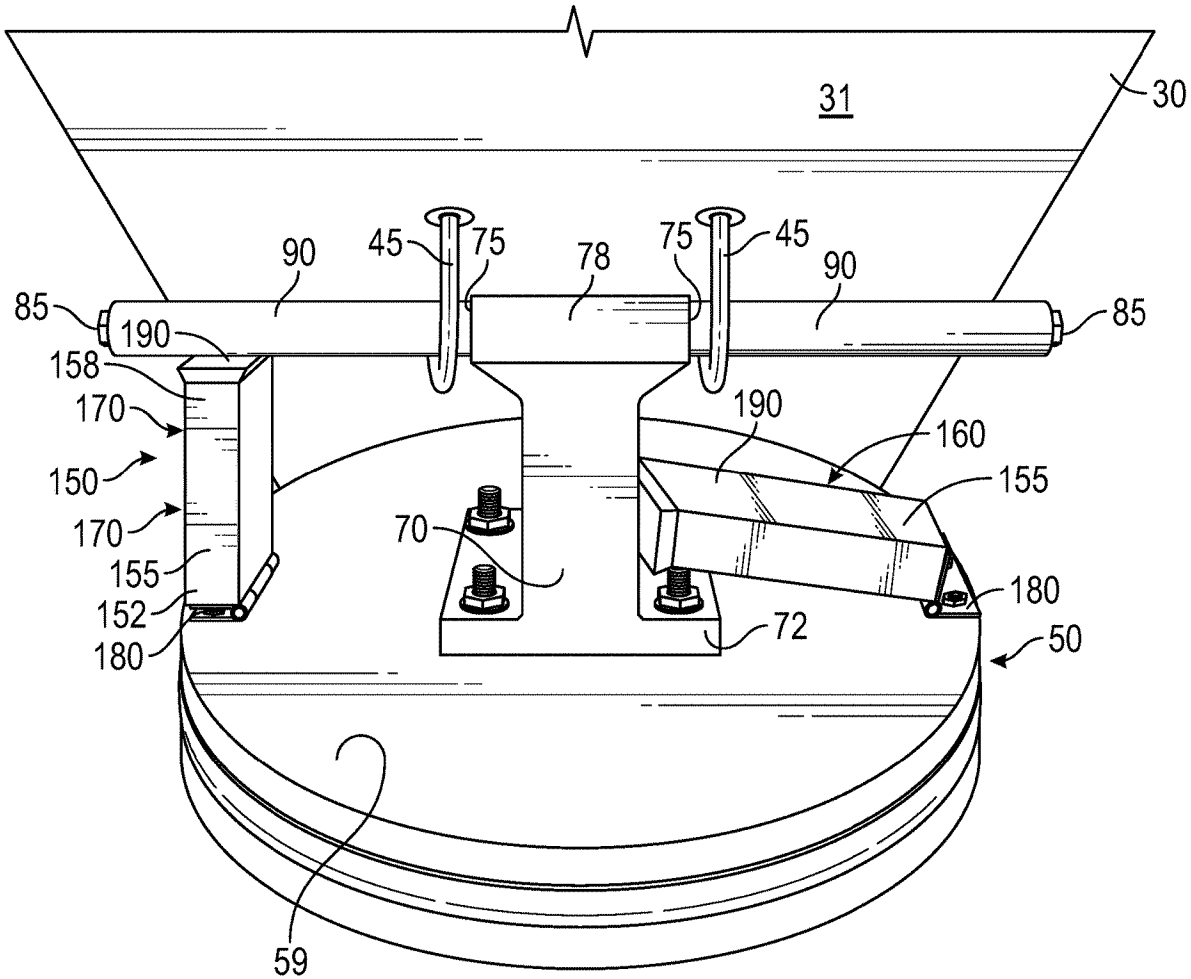
FIG. 4 is a partial front perspective view of the invention, showing a base assembly thereof.

The balancing board 10 further comprises a base 50 (FIGS. 1-2, 4) having a bottom side 52 (FIGS. 1, 2-3) and a top side 58 (FIGS. 1-3). The base 50 may be constructed from polyethylene, polypropylene, or any other mechanically similar material or combination of materials. The bottom side 52 has a bottom surface 51 (FIGS. 2-3) adapted for resting on the horizontal support surface 15. In the preferred embodiment, the bottom surface 51 of the bottom side 52 further includes at least one high-traction foot 100 (FIG. 2-3) for frictionally engaging the support surface 15. The top side 58 has a top surface 59 (FIGS. 2-4). The top side 58 is rotatable with respect to the bottom side 52 at a rotational bearing 60 (FIGS. 2-3). The rotational bearing 60 may be a ball bearing or any other sort of bearing or pivot that allows the top side 58 and bottom side 52 to mutually spin. In the preferred embodiment, the base 50 further comprises a bottom plate 53 (FIGS. 2-3) having the bottom side 52, and a top plate 57 (FIGS. 2-3) having the top side 58. In this embodiment, the rotational bearing 60 is fixed between the bottom plate 53 and the top plate 57 and allows for the top plate 57 to rotate with respect to the bottom plate 53.

The balancing board 10 further comprises a resilient center post 70 (FIGS. 1-4) fixed at a bottom end 72 (FIGS. 2-4) thereof to the top surface 59 of the base 50 and extending upwardly therefrom. The center post 70 may be constructed from polyurethane or any other mechanically similar material that is resilient. The center post 70 has at a top end 78 (FIGS. 2-4) a pair of roller posts 80 (FIGS. 2-3), each extending laterally and horizontally therefrom at opposing sides 75 (FIG. 4) thereof. The roller posts 80 may be constructed from steel or any other mechanically similar material. In the preferred embodiment, the pair of roller posts 80 are integrally formed from a single metal rod 110 (FIG. 3) that traverses a roller post aperture 120 (FIG. 3), which extends laterally through the center post 70 proximate the top end 78 thereof. In practice, the metal rod 110 may be manufactured from any material of sufficient strength to and possessing all the other mechanical characteristics necessary to maintain the structural integrity and full function of the balancing board 10.

A pair of cylindrical rollers 90 (FIGS. 2-4) is each rotationally mounted on one of the roller posts 80 and extends downwardly therefrom lower than the top end 78 of the center post 70. The center post mounting mechanism 40 of the elongated deck 30 engages with the rollers 90, such that each roller 90 is aligned with the central lateral axis $L_2$ of the elongated deck 30 on opposing sides of the longitudinal axis $L_1$ of the elongated deck 30. Each roller post 80 further preferably includes a roller stop 130 (FIGS. 2-3) proximate a distal end 85 (FIGS. 2-4) of the roller post 80 to maintain the roller 90 on the roller post 80. Preferably, the center post mounting mechanism 40 includes a pair of U-bolts 45 (FIGS. 2-4), each fixed with the elongated deck 30 at the bottom surface 31 thereof. Each of the U-bolts 45 straddles the central lateral axis $L_2$ of the elongated deck 30 on opposing sides of the longitudinal axis $L_1$ and on opposing sides of the center post 70. Further, each U-bolt 45 captures one of the rollers 90 between itself and the elongated deck 30.

Also preferably, the balancing board 10 further comprises a pair of tilt brakes 150 (FIG. 4) each fixed with the top surface 59 of the base 50 and having a disengaged position 160 (FIG. 4) that does not inhibit flexing of the center post 70 or yaw or roll of the elongated deck 30, and an engaged position 170 (FIG. 4) that inhibits flexing of the center post and yaw and roll of the elongated deck 30. In this configuration, each tilt brake 150 ideally includes an elongated member 155 (FIG. 4) pivotally fixed with a hinge 180 (FIG. 4) at a lower end 152 (FIG. 4) thereof with the top surface 59 of the base 50 and at an upper end 158 (FIG. 4) with an elongated deck engagement surface 190 (FIG. 4).

Figure 5:
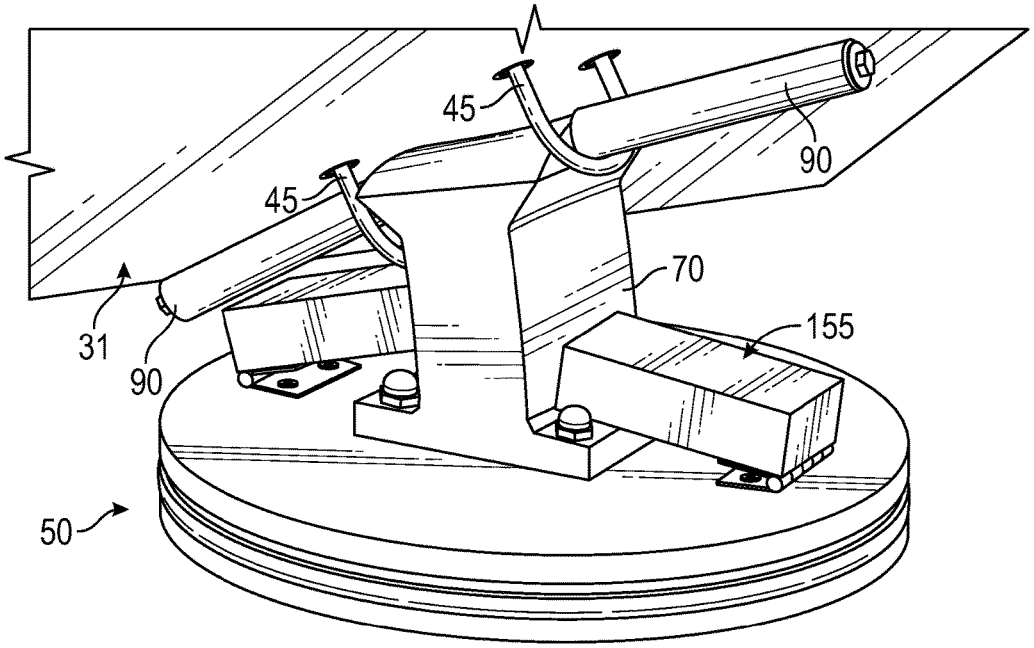
FIG. 5 is a partial perspective view of the invention, illustrating a resilient center post of the invention deforming under a load.

In use, the bottom surface 31 of the elongated deck 30 contacts the center post 70 and is captured thereon with the center post mounting mechanism 40, such that the elongated deck 30 is free to move with a predetermined range, such as one to three centimeters, in a lateral plane and in a forward/backward plane, as well as in the directions of roll, pitch, and yaw. The center post 70 flexes (FIG. 5) when the weight of the user 20 on the elongated deck 30 fails to maintain his balance substantially directly above the center post 70, and snaps back to a central upright position when the user 20 shifts his weight to again be balanced substantially directly above the center post 70. With the tilt brakes 150 engages the user 20 does not have to contend with the center post 70 being resilient as the brakes hold the elongated deck above the center post 70 to prevent the center post 70 from flexing. Further, the tilt brakes 150 prevent the user from having to contend with the tendency of the elongated board 30 to move in roll or yaw directions.

While a particular form of the invention has been illustrated and described, it will be apparent that various modifications can be made without departing from the spirit and scope of the invention. For example, the high-traction foot 100 may be made from rubber or any other mechanically similar material. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above Detailed Description. While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A balancing board for a user to use on a horizontal support surface, the balancing board comprising:

an elongated deck having a top surface, a bottom surface, a longitudinal axis and a central lateral axis, the bottom surface including, at the central lateral axis, a center post mounting mechanism;

a base having a bottom side adapted for resting on the horizontal support surface and a top side, the top side rotatable with respect to the bottom side at a rotational bearing;

a resilient center post fixed at a bottom end thereof to the top surface of the base and extending upwardly therefrom, the resilient center post having, at a top end, a pair of roller posts each of the pair of roller posts extending laterally and horizontally therefrom at opposing sides thereof, a pair of cylindrical rollers each of the pair of cylindrical rollers rotationally mounted on one of the pair of roller posts and extending downwardly therefrom lower than the top end of the resilient center post, the center post mounting mechanism of the elongated deck engaged with the pair of cylindrical rollers such that each of the pair of cylindrical rollers is aligned with the central lateral axis of the elongated deck on opposing sides of the longitudinal axis of the elongated deck;

whereby with the bottom surface of the elongated deck contacting the resilient center post and captured thereon with the center post mounting mechanism, the elongated deck is free to move within a predetermined range in a lateral plane and in a forward/backward plane, as well as in the directions of roll, pitch, and yaw.

2. The balancing board of claim 1 further including a pair of tilt brakes each fixed with the top side of the base and having a disengaged position that does not inhibit flexing of the resilient center post or roll or yaw of the elongated deck, and an engaged position that inhibits flexing of the resilient center post and roll and yaw of the elongated deck.

3. The balancing board of claim 2 wherein each of the pair of tilt brakes include an elongated member pivotally fixed with a hinge at a lower end thereof with the top surface of the base and at an upper end with an elongated deck engagement surface.

4. The balancing board of claim 1 wherein the center post mounting mechanism includes a pair of U-bolts each fixed to the elongated deck at the bottom surface thereof, each pair of U-bolts straddling the central lateral axis of the elongated deck on the opposing sides of the longitudinal axis and on opposing sides of the resilient center post, each of the pair of U-bolts capturing one of the pair of cylindrical rollers between itself and the elongated deck.

5. The balancing board of claim 1 wherein wherein the base further comprises a bottom plate and a top plate, wherein the bottom plate has the bottom side and the top plate has the top side, the rotational bearing being fixed between the bottom plate and the top plate and allowing the top plate to rotate with respect to the bottom plate.

6. The balancing board of claim 1 wherein of the bottom side further includes at least one high-traction foot for frictionally engaging the horizontal support surface.

7. The balancing board of claim 1 wherein the pair of roller posts are integrally formed from a single metal rod that traverses a roller post aperture extending laterally through the resilient center post proximate the top end thereof.

8. The balancing board of claim 1 wherein each of the pair of roller posts includes a roller stop proximate a distal end thereof to maintain the pair of cylindrical rollers on the pair of roller posts.

9. The balancing board of claim 1 wherein the top surface of the elongated deck includes a non-slip texture.

10. The balancing board of claim 1 wherein the elongated deck includes two handle indentations in the bottom surface thereof at opposing ends thereof.

11. A balancing board for a user to use on a horizontal support surface, the balancing board comprising:

an elongated deck having a top surface, a bottom surface, a longitudinal axis and a central lateral axis, the bottom surface including at the central lateral axis a center post mounting mechanism;

a base having a bottom plate having a bottom surface, a top plate having a top surface, a rotational bearing being fixed between the bottom plate and the top plate and allowing the top plate to rotate with respect to the bottom plate, the bottom surface adapted for resting on the horizontal support surface;

a resilient center post fixed at a bottom end thereof to the top surface of the top plate of the base and extending upwardly therefrom, the resilient center post having at a top end a pair of roller posts each of the pair of roller posts extending laterally and horizontally therefrom at opposing sides of the resilient center post;

a pair of cylindrical rollers each rotationally mounted on one of the pair of roller posts and extending downwardly therefrom lower than the top end of the resilient center post, the center post mounting mechanism of the elongated deck engaged with the pair of cylindrical rollers such that each of the pair of cylindrical rollers is aligned with the central lateral axis of the elongated deck on opposing sides of the longitudinal axis of the elongated deck;

the center post mounting mechanism including a pair of U-bolts each fixed with the elongated deck at the bottom surface thereof, each of the pair of U-bolts straddling the central lateral axis of the elongated deck on opposing sides of the longitudinal axis and on opposing sides of the resilient center post, each of the pair of U-bolts capturing one of the pair of cylindrical rollers between itself and the elongated deck; and a pair of tilt brakes each fixed to the top surface of the top plate of the base and having a disengaged position that does not inhibit flexing of the resilient center post or yaw or roll of the elongated deck, and an engaged position that inhibits flexing of the resilient center post and yaw and roll of the elongated deck;

whereby the elongated deck is free to move within a predetermined range in a lateral plane and in a forward/backward plane when the pair of tilt brakes are disengaged, as well as in the directions of roll, pitch, and yaw.

12. The balancing board of claim 11 wherein the bottom surface of the bottom plate further includes at least one high-traction foot for frictionally engaging the horizontal support surface.

13. The balancing board of claim 11 wherein the pair of roller posts are integrally formed from a single metal rod that traverses a roller post aperture extending laterally through the resilient center post proximate the top end thereof.

14. The balancing board of claim 11 wherein each of the pair of roller posts includes a roller stop proximate a distal end thereof to maintain the roller on the respective roller post of the pair of roller posts.

15. The balancing board of claim 11 wherein the top surface of the elongated deck includes a non-slip texture.

16. The balancing board of claim 11 wherein each of the pair of tilt brakes includes an elongated member pivotally fixed with a hinge at a lower end thereof to the top surface of the top plate of the base and at an upper end to an elongated deck engagement surface.

17. The balancing board of claim 11 wherein the elongated deck includes two handle indentations in the bottom surface thereof at opposing ends thereof.

* * * * *